United States Patent [19]

Kuehne

[11] 3,948,168

[45] Apr. 6, 1976

[54] DIGITAL PRINTER

[75] Inventor: Robert S. Kuehne, Corona del Mar, Calif.

[73] Assignee: Willison K. Vance, Corona del Mar, Calif. ; a part interest

[22] Filed: Aug. 14, 1974

[21] Appl. No.: 497,139

[52] U.S. Cl. ..... 101/93.05; 346/101

[51] Int. Cl.[2] ..... B41J 25/00

[58] Field of Search..... 101/93.04, 93.05; 197/1 R; 346/101

[56] References Cited

UNITED STATES PATENTS

| | | | |
|---|---|---|---|
| 2,202,855 | 6/1940 | Hogan et al. | 346/101 |
| 3,286,625 | 11/1966 | Petit | 346/101 |
| 3,678,847 | 7/1972 | Pear, Jr. et al. | 346/101 |

FOREIGN PATENTS OR APPLICATIONS

| | | | |
|---|---|---|---|
| 573,410 | 4/1959 | United Kingdom | 346/101 |

OTHER PUBLICATIONS

Alden "Flying Spot" Helix Recorder As Show in Alden Catalog 3/1971 pp. cover–15.

*Primary Examiner*—Paul E. Shapiro
*Attorney, Agent, or Firm*—Dean Sandford

[57] ABSTRACT

A printer for printing in alpha-numeric character form information from a digital source available in the form of a video-type signal representative of alpha-numeric characters corresponding to the digital information. The printer utilizes a high speed rotating spindle having at least one spiral electrical conductor on its periphery and means for forming a mark on a continuous sheet of paper in response to an electrical signal applied to the spiral conductor. The paper is moved past the spindle at a velocity proportional to, but substantially less than the tangential velocity of the spiral conductor. The video-signal is received into a double buffer memory and unloaded to the spiral conductors in phase sequence with the rotation of the spindle whereby a matrix of dots is formed on the paper in designated locations so as to produce alpha-numeric characters corresponding to the digital information.

18 Claims, 12 Drawing Figures

DIGITAL PRINTER

This invention relates to digital printers, and more particularly to high speed printers for printing information from a digital source in alpha-numeric character form.

The principal digital output printing devices in use at the present time are full character positioning printers, full character on-the-fly printers, and dot matrix printers, which all have certain well known characteristics.

Full character positioning printers print by positioning an embossed character in front of the paper in response to digital commands held in the device's storage register and causing a solenoid driven hammer to push the character against the paper. Exemplary of such devices are the character serial printers exemplary of which are the teletypewriter and electric typewriters such as the IBM Selectric typewriter. While these devices produce good quality, legible output, they are generally low speed devices having print speeds of 10 to 15 characters per second.

Full character on-the-fly printers use a set of characters embossed on a print wheel or print chain which is driven by a synchronous motor. Digital commands held in the machine's storage register cause solenoid driven hammers to drive the paper against the selected characters as they move into printing position, i.e., on-the-fly. In the simplest version of the on-the-fly printers, a set of characters is embossed in a spiral around the outer surface of the print wheel. Typically, the print wheel is driven at a speed of 2000 rpm, or approximately 33 rps. This print on-the-fly operation involves tight dynamic tolerances, with only about 15 microseconds of hammer-to-paper contact time being permitted; otherwise, the print wheels high speed rotation would cause the printed character to smear vertically upon the paper. Further, hammer firing and flight time demand excellent long-term stability to avoid the hammer impacting too late, or too early, causing the printed character to be printed above or below the print line. Hybrid printers are available that use three character sets on a single print wheel to print an average of three characters in the time for the conventional serial machines to print one character. Consequently, such a machine produces full character serial printouts at speeds of 100 characters per second.

Dot matrix printers create characters from patterns of dots. Characters, instead of being embossed on the paper typewriter-fashion, are created from patterns of dots formed by a pin matrix driven against the paper by solenoid hammers. Each character is formed from a 5×7 or 7×9 dot matrix, with electronic circuitry determining which of the dots must be printed to form an alphanumeric symbol. While these devices exhibit higher print speeds, they are generally more delicate and mechanically unreliable than the full character printers.

The presently known printers do not have print speeds that are sufficiently high to operate efficiently with high speed digital signal sources, such as the modern digital computers. The full character serial positioning printers have maximum capacities of 10 to 15 characters per second. The character serial on-the-fly printers have speeds of up to 33 characters per second, and the multiple character serial on-the-fly printers operate at speeds of up to 100 characters per second. The serial dot matrix printers are limited to maximum speeds of about 165 characters per second. Although print speeds of 100 to 3,000 lines per minute are obtainable by operating the printer in a parallel mode, such devices are mechanically complex and much more expensive than the character serial printers. Higher speed, mechanically simple devices for the printing of digital computer output information in alphanumeric form are needed.

The dot matrix printers generally lack in legibility as compared to the full character printers, but are much quieter in operation. Simple type font changes can be made by changing the logic controlling the firing of the hammer. In the full character printers type font changes require a change of print wheels, but these devices provide more flexibility in type styles than the dot matrix printers. The dot matrix printers utilize ribbon or special pressure sensitive paper. Although the full character printers can use both ribbons and pressure sensitive paper, these machines also can be adapted to use ink rollers.

The on-the-fly printers having separate sets of character fonts can be adapted to print as many as three different colors, which cannot be accomplished with the dot matrix devices without changing the print ribbon.

Thus, need exists for a high speed, reliable, digital printer to print information from a digital source in alpha-numeric character form that is quiet in operation and adaptable to changes of character fonts and size.

Accordingly, a principal object of this invention is to provide a high speed printer to print digital information in alpha-numeric character form.

Another object of the invention is to provide a mechanically simple, high speed printer to print digital information in alpha-numeric character form.

Still another object of the invention is to provide a high speed printer adapted to print the output from a digital computer in alpha-numeric character form.

A still further object of the invention is to provide a high speed printer adapted to print the output from a digital computer in alpha-numeric character form that is capable of interfacing with conventional buffer memory, recirculating type display devices.

A yet further object of the invention is to provide a high speed printer for printing in alpha-numeric character form information from a digital source available as video-type electronic signal representative of alphanumeric characters corresponding to the digital information.

The manner in which these and other objects and advantages of the invention are attained will be apparent from the following description and the accompanying drawings, in which.

Briefly, this invention is a digital printer for printing in alpha-numeric form information from a digital source available in the form of a video-type signal representative of alpha-numeric characters corresponding to the digital information. The printer includes a rotatable spindle having at least one spiral electrical conductor at its periphery; drive means for rotating the spindle at a prescribed substantially constant speed; paper feed means for moving a continuous sheet of paper past the rotatable spindle in a direction normal to the axis of the spindle and at a velocity proportional to, but substantially less than the tangential velocity of the spiral electrical conductor; and printing means for forming a mark on the paper responsive to an electrical signal applied to the spiral conductor. A printer control means receives a video-type electronic signal representative of alpha-numeric characters corresponding to information from a digital source and produces electrical output signals that are applied to each of the spiral electrical conductors in phase sequence with the rotation of the spindle whereby a matrix of dots is formed on the paper in designated locations so as to produce alpha-numeric characters corresponding to the digital information.

Figure 1:
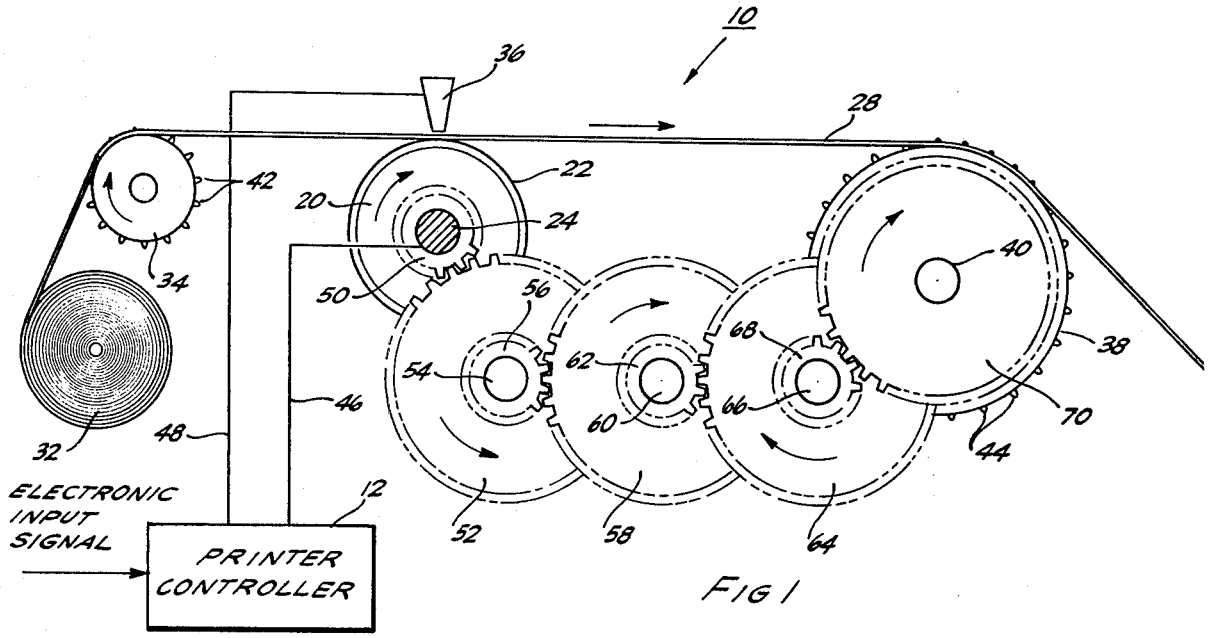
FIG. 1 is a side view, partially in cross-section, schematically illustrating one embodiment of the digital printer of the present invention.
Figure 2:
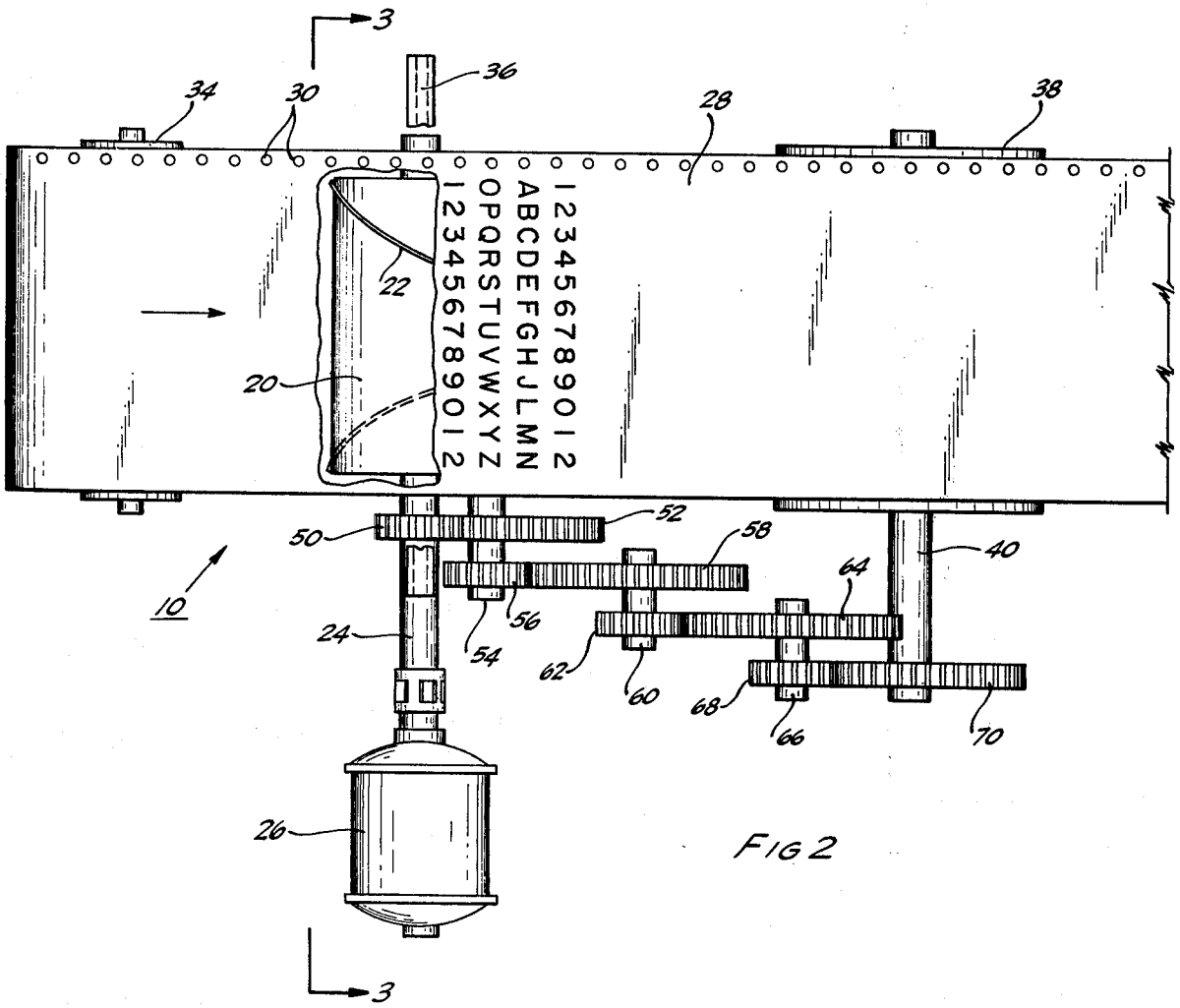
FIG. 2 is a partially cutaway plan view schematically illustrating the printer unit.
Figure 3:
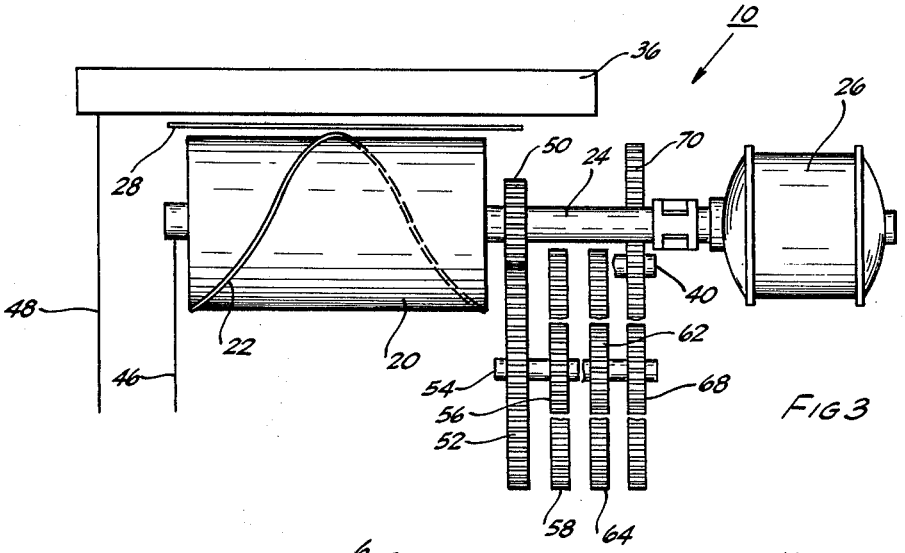
FIG. 3 is a cross-sectional view of the printer taken along the line 3—3 of FIG. 2.

Referring now to FIGS. 1 through 3, the digital printer of this invention is comprised of printer unit 10 and printer controller 12. Printer unit 10 includes a rotatable spindle 20 having a spiral conductor 22 at its periphery extending the full width of the print column and making one complete revolution around the spindle, i.e., extending around the periphery of the spindle for 360°. Spindle 20 is rotatably mounted on shaft 24 which is driven by synchronous motor 26. A continuous sheet of paper 28 having a plurality of perforations 30 along one or both edges is fed from paper supply drum 32 over idler roller 34 so as to pass between spindle 20 and stationary print head 36 in a direction normal to the axis of spindle 20 and print head 36, the paper being driven by paper drive roller 38 mounted on shaft 40. Idler roller 34 and paper drive roller 38 are provided with pegs 42 and 44, respectively, spaced to engage the perforations 30 in paper 28.

Paper drive roller 38 is driven by motor 26 through a speed reducing gear train so that paper drive roller 38 rotates at a speed proportional to, but substantially lower than the speed of spindle 20. In this manner, the tangential velocity of spiral electrical conductor 22 is maintained considerably higher than the velocity of the paper.

In the illustrated embodiment, the speed reducing gear train includes spur gear 50 mounted on shaft 24, which drives larger diameter spur gear 52 mounted on shaft 54. Smaller diameter spur gear 56 coaxially mounted on shaft 54 drives a larger diameter spur gear 58 coaxially mounted on shaft 60 along with small diameter spur gear 62, which drives large diameter spur gear 64 mounted on shaft 66. Small diameter spur gear 68 coaxially mounted on shaft 66 drives large diameter spur gear 70 mounted on paper roller shaft 40. The larger diameter gears 52, 58, 64 and 70 have diameters four times larger than the diameters of small diameter gears 50, 56, 62 and 68. This four stage speed reducing gear train provides a speed reduction of 1:256, i.e., paper drive roller 38 turns one revolution for every 256 revolutions of spindle 20. The relative speeds of rotation of spindle 20 and paper drive roller 38 to each other are constant regardless of the speed of motor 26, and the diameter of paper drive roller 38 is such that paper 28 moves past print head 36 a total of 256 dot widths per revolution of drive roller 38. In this manner, the paper is moved between spindle 30 and print head 36 at a velocity proportional to, but substantially less than the tangential velocity of electrical conductor 22. The gear train is arranged so that spindle 20 and paper drive drum 38 rotate in the same direction. Thus, the paper and the segment of spiral electrical conductor 22 in juxtaposition thereto are moving in the same direction.

It is to be recognized that considerable flexibility exists in the selection of the print speed and the relative speeds of rotation of spindle 20 and paper drive roller 38. Also, various speed reducing means such as chain and sprocket drives and the like can be employed, so long as the relative speeds of rotation of spindle 20 and paper drive roller 38 are constant so as to maintain the relative tangential velocity of spiral conductor 22 and the velocity of paper 28 constant.

A video-type electronic signal representative of alpha-numeric characters corresponding to the digital information is fed to printer controller 12. The digital printer can be interfaced with a digital source, such as a high speed digital computer or other source of digital information, through a recirculating-type buffer memory device capable of producing a video-type electronic signal representative of alpha-numeric characters. Cathode ray tube video display (CRT) terminals conventionally contain electronic circuitry to convert a digital input signal to alpha-numeric character form capable of being displayed on the cathode ray tube. The video output signal from a CRT display terminal can be employed as the electronic character matrix signal fed to printer controller 12. Thus, a conventional CRT display terminal having alpha-numeric character capability can be the interface device between the digital printer and the source of the digital information. A preferred CRT display terminal found especially useful as an interface device is marketed by International Telephone and Telegraph Corporation under the trademark ITT Model 3501 Asciscope.

Alternatively, the interface device can be a specially constructed electronic device employing circuitry similar to that employed in a CRT display terminal and capable of converting the digital information to alpha-numeric character form, but omitting the cathode ray display tube. The output of such device is a videotype electronic signal representative of alpha-numeric characters corresponding to the digital information input to the device. In an alternative mode of operation sometimes found desirable in cases where the printer speed is in the same order of magnitude as the speed of the digital device, the printer can be synchronized with the recirculating-type buffer memory of the digital device, such as a disk memory storage unit having digital to alpha-numeric character conversion capability. The video-type signal produced by such device can be fed directly to the digital printer without the need of additional interface devices.

However, in whatever manner it is generated, the videotype electronic signal representative of alpha-numeric characters corresponding to the digital information is fed to printer controller 12, which stores the input in a double buffer memory and unloads it to the spiral conductor in phase sequence with the rotation of the spindle whereby a matrix of dots is formed on the paper in designated locations so as to form thereon alpha-numeric characters corresponding to the information from the digital source. Printer controller 12 is electrically connected to spiral electrical conductor 22 and print head 36, respectively, by electrical conductors 46 and 48. Synchronous motor 26 and printer controller 12 are driven by the same 60 Hertz power source to maintain the timing between the spindle rotation and the controller output.

The printed characters are formed by a selected matrix of dots placed on the paper in an appropriate configuration to form an alpha-numeric character corresponding to the digital input signal. The output of the printer controller is synchronized with the rotation of the spindle so that spiral conductor 22 is charged with the printer controller output signal at the instant that it intersects the longitudinal axis of print head 36 at the location of the dot required in the formation of the alpha-numeric character. Thus, a mark is formed on the paper at the appropriate location.

In the illustrated embodiment employing a single 360° spiral conductor on each spindle, a rwo of dots one dot width wide extending the length of the spindle can be printed at each rotation of the spindle. The size of the dot is determined by the character size desired and the number of dots in the matrix selected. Typically, a one dot width space is provided between adjacent characters in each print line and a one dot width space is provided between adjacent print lines. Thus, a character matrix 5 dots wide and 7 dots high would be printed as a 6×8 matrix including the spaces. The number of characters per inch of print line and the number of revolutions of the spindle required per character depend upon the number of dots in the matrix and the character size.

Printing can be accomplished by the use of magnetic ink or electrostatic printing on conventional paper, by means of thermal marking on heat sensitive paper, or by any other convenient means where a mark is formed on the paper in response to an electrical signal applied to spiral conductor 22. Print head 36 is selected based on the print system employed. Thus, where a magnetic ink print system is employed, print head 36 includes a reservoir of magnetic ink and a magnetic ink dispenser; where an electrostatic print system is employed, print head 36 is an electrostatic printer; and, where a thermal system is employed, print head 36 includes an electrically conductive element. In this latter instance, the electrical signal passes from spiral conductor 22, through the paper to the conductor in print head 36, causing a mark to be formed on the heat sensitive paper.

A plurality of spiral conductors can be mounted on spindle 20. Where a plurality of electrically isolated spirals are employed, they may be used to obtain foreground and background printing; heavy and light line or character printing; or for printing from different sources of material, i.e., from different digital sources; or for printing different kinds of material. Also, spiral conductors can be mounted on the spindle in tandem to extend the length of the spindle so as to print a wider output. In another useful configuration, two 180° spiral conductors are mounted on the spindle and two conductors are employed in the print head to print two colors, or from two sources. Thus, it is apparent that a wide variety of spiral conductor and print head conductor configurations can be employed depending upon the particular print arrangement desired.

There is an optimum relationship of the diameter and the length of spindle 20 for the formation of clear, precise dots having a uniform circular shape, clarity of edge, and uniform darkness of color. When the circumference of the spindle equals its length, spiral conductor 22 is at a 45° angle to the longitudinal axis of print head 36. Reducing the length of spindle 20 will place the spiral more perpendicular to the axis of print head 36, but will reduce the number of characters that can be formed on each print line per spindle. Increasing the length of spindle 20 will make spiral conductor 22 more parallel to the axis of print head 36 and reduce the sharpness of the characters produced.

Figure 4:
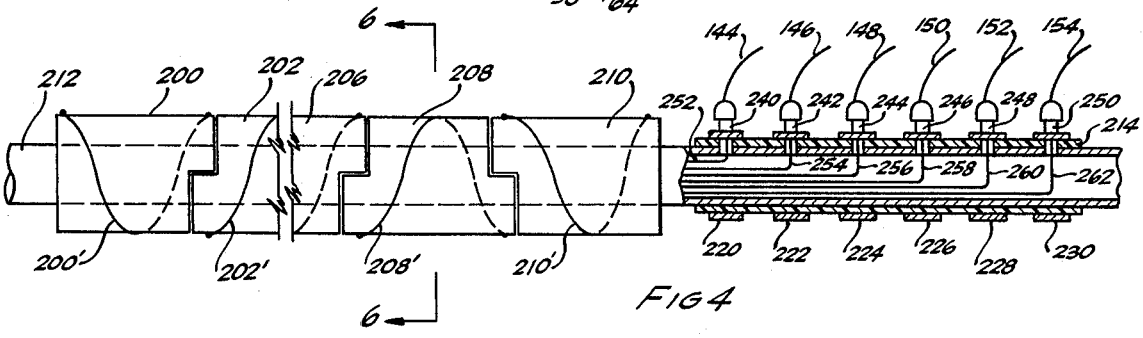
FIG. 4 is a side view, partially in cross-section, illustrating a rotatable spindle having multiple spiral conductors.
Figure 5:
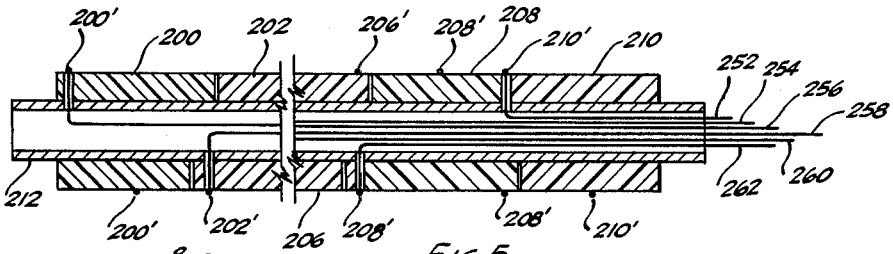
FIG. 5 is a longitudinal cross-sectional view of the spindle illustrated in FIG. 4.
Figure 6:
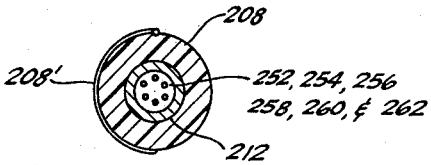
FIG. 6 is a transverse cross-sectional view of the spindle taken along the line 6—6 of FIG. 4.

One preferred embodiment of a multiple element spindle employing six elements having six separate spiral conductors is illustrated in FIGS. 4 through 6. Six elements 200, 202, 204, 206, 208 and 210 (element 204 not being shown) constructed of non-electrically conductive molded plastic are mounted on hollow shaft 212. Adjacent elements are provided with interlocking abutting edges to prevent independent movement of the elements on the shaft. Each element is provided with an electrical conductor 200′, 202′, 204′, 206′, 208′ and 210′, respectively, mounted in a single 360° spiral on the corresponding element. The electrical conductors can be metal wires affixed to the surface of the element, or embedded in the surface of the plastic material, or the electrical conductors can be plated onto the surface of the elements. The spiral electrical conductors on adjacent elements are displaced 180° so that the conductors on abutting elements can be terminated in the same exact transverse plane to prevent any overlap or gap that would result in double printing or a gap in the printed material.

Shaft 212 is provided with a non-electrically conductive plastic sleeve 214 and a plurality of electrically conductive rings 220, 222, 224, 226, 228 and 230 mounted in spaced relationship on sleeve 214. A plurality of stationary electrically conductive brushes 240, 242, 244, 246, 248 and 250 are in electrical contact with the conductive rings mounted on the rotatable shaft and electrically connected to print controller 12 through conductors 144, 146, 148, 150, 152 and 154, respectively. Shaft 212 and sleeve 214 are apertured adjacent to each of the electrically conductive rings and the shaft and spindle elements are apertured adjacent to the terminus of each of the spiral electrical conductors to accommodate the insulated electrical conductors 252, 254, 256, 258, 260 and 262 which electrically connect each of the spiral conductors with the corresponding electrically conductive rings.

Figure 7:
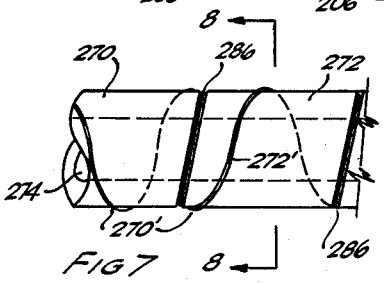
FIG. 7 is a side view illustrating another embodiment of the spindle particularly suited for high speed operation.
Figure 8:
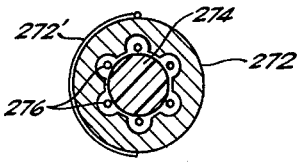
FIG. 8 is a transverse cross-sectional view taken along the line 8—8 of FIG. 7.

FIGS. 7 and 8 illustrate another embodiment of multiple element spindle especially adapted for higher speed operations. A plurality of electrically conductive metallic elements 270 and 272 are mounted on non-electrically conductive shaft 274. The abutting ends of adjacent elements are beveled to interlock the elements, and provided with an insulating material 286 between adjacent elements to electrically isolate the individual elements. Each element is provided with an integral raised lip 270' and 272', respectively, arranged in a single 360° spiral on the surface of the element. The interior surface of the spindle elements are fluted to provide a raceway for the insulated electrical conductors 276, and shaft 274 is constructed of high strength nylon or other non-electrically conductive material. Alternatively, shaft 274 can be constructed of metal and a suitable insulated sleeve provided to assure that each spindle element is electrically isolated. In this embodiment of the invention, the entire conductive spindle element is charged with the electrical output signal from printer controller 12, with the marks being made on the paper at the location of the intersection of the integral lip and the conductive element in printer head 36 at the instant that the electrical signal is applied.

Figure 9:
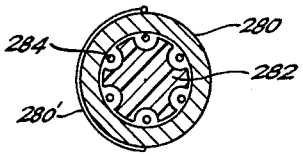
FIG. 9 is a transverse cross-sectional view illustrating another embodiment of spindle construction.

FIG. 9 illustrates an alternative embodiment wherein the electrically conductive element 280 having integral conductive lip 280' is mounted on non-conductive shaft 282. In this embodiment shaft 282 is grooved to provide raceways for the insulated electrical conductors 284.

The commercially available electronic character matrix generators conventionally employ either 5×7 or 7×9 matrices of electronic signals per alpha-numeric character. The digital printer can be readily programmed to function with either of these systems and the appropriate system can be made switch selectable.

Conventional CRT display terminals used to interface with the digital source are refreshed at a high rate, i.e., at a rate in the order of 60 times per second. The printer is programmed to print while the CRT display terminal is in the refresh mode. Since the instantaneous writing or refresh rate of the display terminal is much higher than that of the printer, and since the printer utilizes the display video signal, the printer must employ a memory to hold a line of dots while it is being embossed on the paper. Printer controller 12 utilizes a double buffer memory, one memory being loaded while the other is being unloaded, and vice versa. The spindle rotation is timed so that the printer will print a line of dots during each refresh cycle of the display terminal. This timing is essential to the proper operation of the printer.

Since the relative tangential velocity of spiral conductor 22 and paper 28 are constant, the printer output rate is a function of the speed of rotation of spindle 20, which is timed to coincide with the refresh rate of the digital source. Thus, increasing the refresh rate will effect an increase in the speed of rotation of the spindle and increase the printer output rate.

Figure 10:
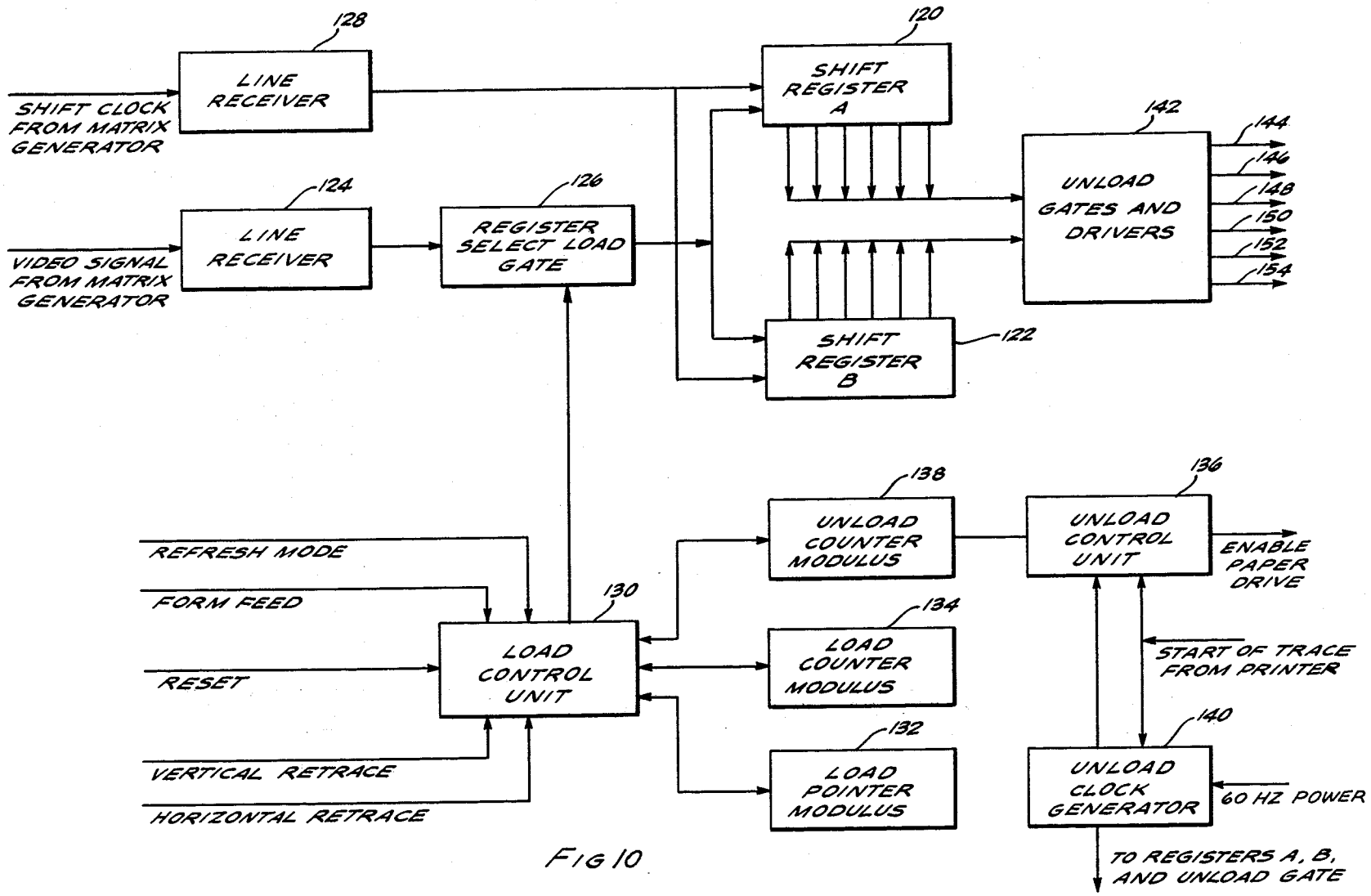
FIG. 10 is a block diagram schematically illustrating the electronic circuitry of the printer controller.

FIG. 10 illustrates the circuitry, in block diagram form, of one embodiment of printer controller 12 especially adapted for use with the six element printer illustrated in FIGS. 4 through 9. The double buffer memory is provided by shift register A and shift register B, identified as elements 120 and 122, respectively. Each shift register has six memory sections, i.e., one section per spiral conductor, and a storage capacity of 72 bits per section. The video-type electronic signal from the alpha-numeric character generator is transmitted through line receiver 124 to register select load gate 126. The output from gate 126 is alternately shifted between shift registers A and B. A clock signal from the alpha-numeric character generator is received through line receiver 128 and passed directly to the shift registers. A form feed command signal is generated in the digital source and passed through the display terminal to load control unit 130. Refresh mode, reset, vertical retrace and horizontal retrace command signals are generated in the display terminal and transmitted to load control unit 130.

Load pointer 132 is a counter that maintains a count of the number of lines printed on each page and load counter 134 is a counter that counts the number of lines scanned by the display terminal. The same 60 Hertz electrical supply that drives motor 26 is fed to unload clock generator 140. The output of unload clock generator 140 controls the timing of unload control unit 136, shift registers A and B, and unload gates 142. The output of shift registers A and B is unloaded through conductors 144, 146, 148, 150, 152 and 154 to the six spiral conductors on the spindles, and the number of shifts unloaded is counted by unload counter 138.

Figure 11:
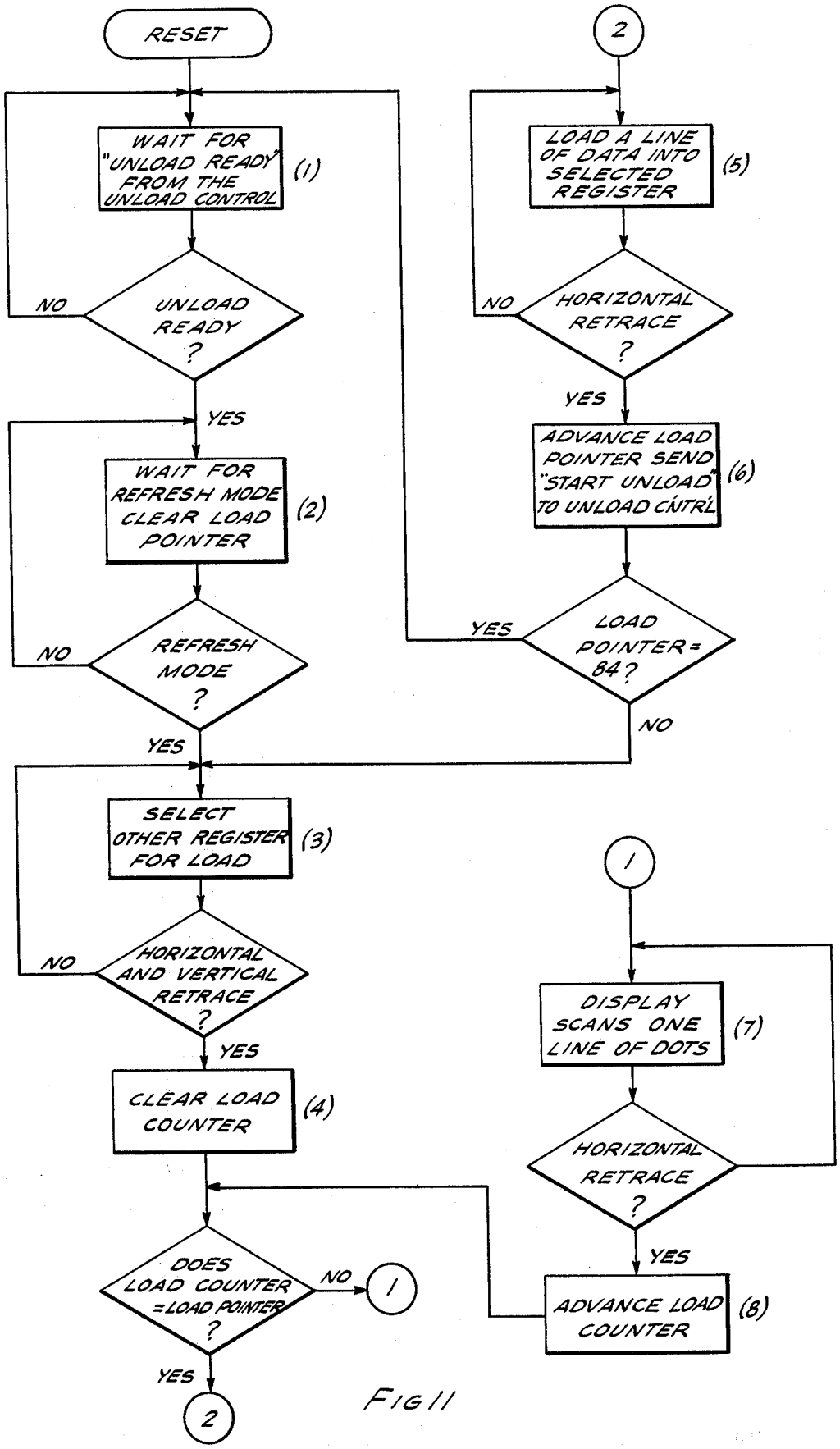
FIG. 11 is a logic flow diagram of the printer controller in the load mode.
Figure 12:
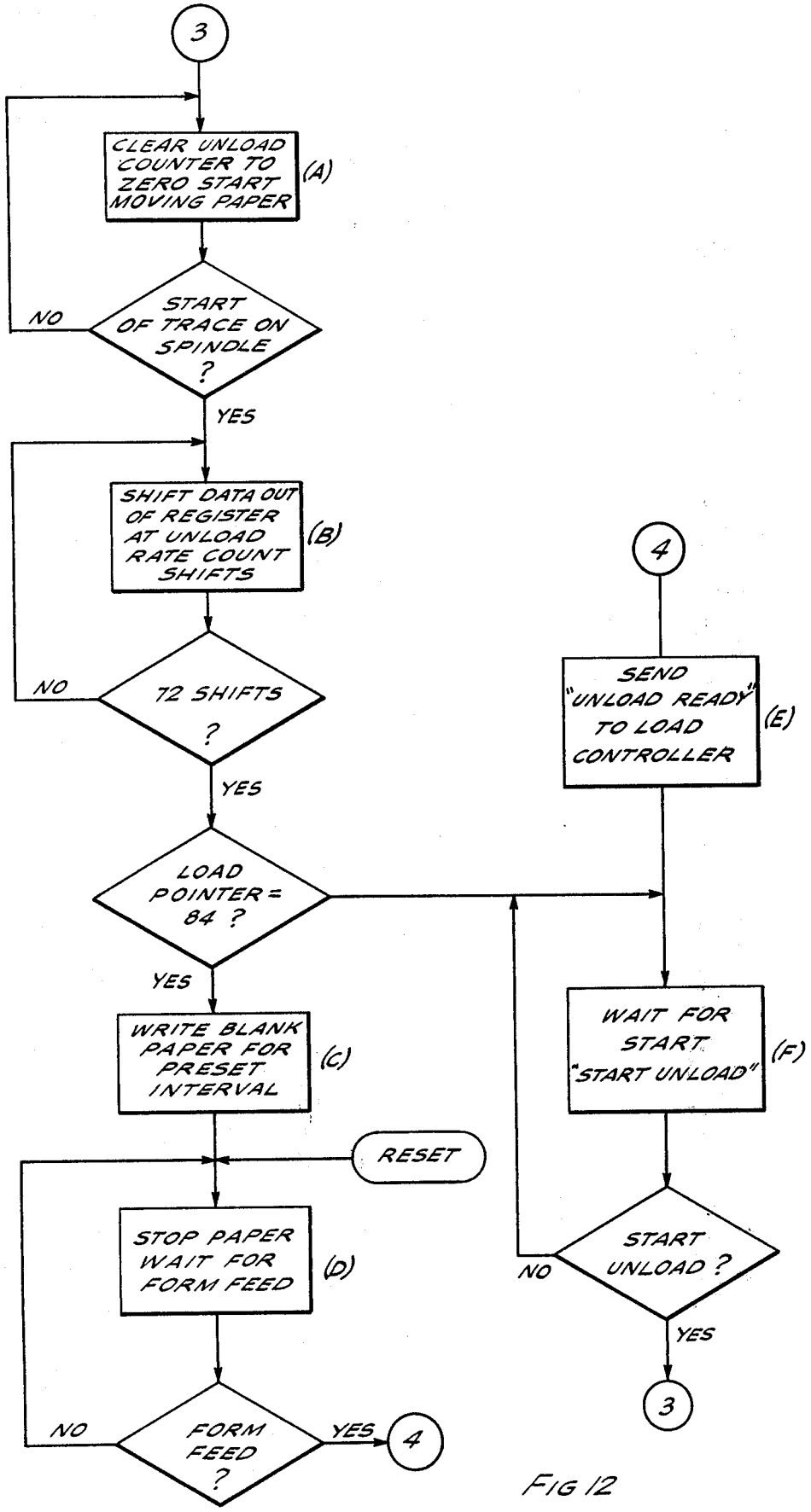
FIG. 12 is a logic flow diagram of the printer controller in the unload mode.

FIGS. 11 and 12 are logic flow diagrams illustrating the operation of printer controller 12 in the load and unload modes, respectively. When power is applied, or upon receipt of a reset signal from the display terminal, load controller 130 sets to state 1 and the unload controller sets to state D. These states will be maintained with the paper stopped until a form feed command is received. The form feed command advances unload control unit 136 to state E which causes an "unload ready" signal to be sent to load control unit 130 and advances to state F where it waits for the next "start unload" signal from load control unit 130.

The "unload ready" signal from unload control unit 136 causes load control unit 130 to advance to state 2 where it waits for the display terminal to enter the refresh mode and clears load pointer 132. Receipt of a refresh mode signal advances load controller 130 to state 3 where it selects one of the shift registers 120 or 122 to receive a line of video data. Assuming, for example, that shift register A is selected, as soon as a vertical retrace signal is received, load control unit 130 enters state 4 and clears load counter 134.

In state 4, load control unit 130 checks for a match between load counter 134 and load pointer 132. If they match, load control unit 130 enters state 5 and loads a line of video data into shift register A. Receipt of the horizontal retrace signal from the display terminal indicates that the line is complete and advances load control unit 130 to state 6 which causes a start unload signal to be sent to unload control unit 136. Load control unit 130 then checks the contents of load pointer 132. A count of 84 indicates that the page is complete, which returns load control unit 130 to state 1 and waits for the next unload ready signal from unload control unit 136. If the count in load pointer 132 is less than 84, load control unit 130 jumps to state 3, selects shift register B to receive the next line of video data, and waits for the next frame to begin.

If, when load control unit 130 is in state 4, the count in load counter 134 does not equal the count in load pointer 132, load control unit 130 advances to state 7, waits for the display terminal to scan the next line of video data, advances load counter 134 (in state 7), and again checks for a match between the count in load counter 134 and load pointer 132. This loop will continue until a match exists.

All the while, unload controller 136 has been waiting in state F for the "start unload" signal. When it is received, unload controller 136 advances to state A where it starts the paper moving and sets the unload counter to zero. The start of the trace advances unload control unit 136 to state B where it shifts the contents of shift register A out to the spiral conductors. This unloading operation occurs from all six segments of the shift register simultaneously. The individual sections of shift registers A and B, elements 120 and 122, respectively, are bidirectional so that they can shift out the data to match the phase of the corresponding spiral conductors 200', 202', 204', 206', 208' and 210'. Thus, only 72 shifts are required to write a complete line on the paper. After 72 shifts, unload counter 138 checks the contents of load pointer 132. If it is 84, unload control unit 136 advances to state C where it writes a short length of blank paper to form a margin between pages and then stops in state D and waits for the next form feed command from the display terminal.

Thus, the printer prints out one line of video dots during each refresh cycle of the display terminal. The digital source must be programmed to keep each page present in the refresh memory of the display terminal until the printer has had an opportunity to print the entire page. If the digital source is interrupted during a print operation, the printer controller will wait until a new page is loaded into the display terminal, as signaled by a form feed signal from the digital source.

The following data illustrate the performance of a typical multi-element printing unit adapted for use with electronic alpha-numeric character generators developing either 5×7 or 7×9 matrices. In the illustrative device, the basic spindle elements are 0.75 inch in diameter. The device has a printing capacity of 72 marks per revolution, i.e., 55° of spindle rotation is equivalent to one mark, and a print size of 12 characters per inch of print line.

| | 5×7 Matrix | 7×9 Matrix |
|---|---|---|
| Spindle size | 0.75 in.×1.0 in. | 0.75 in×0.75 in. |
| Matrix on paper | 6×8 matrix | 8×10 matrix |
| Revolutions per character | 8 | 10 |
| Print lines per minute | 450 | 360 |
| Paper travel in inches | 0.75 in./sec. | 0.6 in./sec. |
| Characters per spindle | 12 characters | 9 characters |

The spindle element is the basic unit and either a single element or any convenient member of multiple elements can be employed depending upon the width of the column to be printed.

While various embodiments of the invention have been described, it will be obvious to those skilled in the art that it is not so limited, but is susceptible of various changes and modifications, which are considered within the spirit and scope of the invention as defined by the attached claims.

Having now described the invention, I claim:

1. A digital printer for printing in alpha-numeric character form information from a digital source available in the form of a video-type signal representative of alpha-numeric characters corresponding to the digital information, which comprises:

a plurality of spindles mounted in tandem on a common rotatable shaft, each of said spindles having a spiral electrical conductor at its periphery, said electrical conductors being electrically isolated from each other, and wherein the spiral conductors on adjacent spindles are displaced about the axis of said spindles and the spiral conductors on abutting spindles are terminated in the same exact transverse plane;

drive means for rotating said spindles at a prescribed substantially constant speed;

paper feed means for moving a continuous sheet of paper past said rotatably mounted spindles in a direction normal to the axis of said spindles and at a velocity proportional to, but substantially less than the tangential velocity of the spiral electrical conductors;

printing means for forming a mark on said paper responsive to an electrical signal applied to each of said spiral electrical conductors;

printer control means for receiving a video-type electronic signal representative of alpha-numeric characters corresponding to information from a digital source and producing a plurality of separate electrical output signals equal in number to the number of spiral electrical conductors and said electrical output signals being in phase sequence with the rotation of the spindle; and electrical conductor means for separately conducting one of said electrical output signals from said printer control means to each of said spiral electrical conductors;

whereby a matrix of marks is placed on the paper so as to form alpha-numeric characters corresponding to the information from said digital source.

2. The device defined in claim 1 wherein the spiral conductors on adjacent spindles are displaced 180°.

3. The device defined in claim 1 wherein said drive means includes a synchronous electric motor and wherein said motor and said printer control means are supplied by power from a common source.

4. The device defined in claim 3 wherein said paper drive means includes a rotatably mounted paper drive roller and including a speed reducing drive means for rotatably driving said paper drive roller from said synchronous electrical motor at a speed of rotation proportional to, but substantially less than the speed of rotation of said spindles.

5. The device defined in claim 4 wherein said spindles and said paper drive roller are rotatably driven in the same direction so that the paper and the segment of said spiral conductors in juxtaposition thereto are moving in the same direction.

6. The device defined in claim 1 wherein said spindles are constructed of a non-electrically conductive material and said spiral electrical conductors are constructed of an electrically conductive material.

7. The device defined in claim 1 wherein said spindles are constructed of an electrically conductive material, said spiral electrical conductors are raised lips formed integrally with said spindles and projecting outwardly from the surface thereof, and said spindles are electrically isolated from each other.

8. The device defined in claim 1 wherein said video-type signal representative of alpha-numeric characters is received from a recirculating-type buffer memory device refreshed at a predetermined rate, and wherein said print control means comprises:

first and second shift registers, each of said shift registers being capable of storing information corresponding to one complete print line of marks;

means for loading said video-type signal corresponding to one print line of marks into one of said registers and loading said video-type signal corresponding to the next print line of marks into the other of said shift registers, the video-type signal being alternately shifted between said shift registers;

means for alternately unloading the information stored in the shift registers to the spiral electrical conductors, the inactive shift register being unloaded during the period that the other of said shift registers is being loaded; and means to determine the end of each page of information and provide a space between adjacent pages.

9. The device defined in claim 8 wherein one of said shift registers is loaded and the other of said shift registers is unloaded during each refresh cycle of said buffer memory device.

10. A digital printer for printing in alpha-numeric character form digital information received from a recirculating-type buffer memory device in the form of a video-type signal refreshed at a predetermined rate, which comprises:

a plurality of spindles mounted in tandem on a common rotatable shaft, each of said spindles having a spiral electrical conductor at its periphery extending 360° around said spindle, said electrical conductors being electrically isolated from each other, and wherein the spiral conductors on adjacent spindles are displaced about the axis of said spindles and the spiral conductors on abutting spindles are terminated in the same exact transverse plane;

a synchronous electric motor for rotatably driving said spindles at a substantially constant speed;

a rotatably mounted paper drive roller for moving a continuous sheet of paper past said rotatable spindles in a direction normal to the axis of said spindles;

speed reducing means for rotatably driving said paper drive roller from said synchronous electrical motor in the same direction of rotation as said spindles and at a speed of rotation proportional to, but substantially less than the speed of rotation of said spindles so that the paper and the segments of said spiral electrical conductors in juxtaposition thereto are moving in the same direction, with the velocity of the paper being substantially less than the tangential velocity of the spiral conductors;

printing means for forming a mark on said paper responsive to an electrical signal applied to said spiral electrical conductors;

printer control means for receiving a video-type electronic signal representative of alpha-numeric characters corresponding to said digital information and simultaneously producing a plurality of electrical output signals corresponding in number to the number of said spindles, each of said electrical output signals being in phase sequence with the rotation of the respective spindle; and electrical conductor means for separately conducting the output signals from said printer control means to the corresponding spiral electrical conductor; whereby a matrix of marks is placed on the paper so as to form alpha-numeric characters corresponding to said digital information.

11. The device defined in claim 10 wherein the spiral conductors on adjacent spindles are displaced 180°.

12. The device defined in claim 10 wherein said synchronous electric motor and printer control means are supplied by power from a common source.

13. The device defined in claim 10 wherein said spindles are constructed of a non-electrically conductive material and said spiral electrical conductors are constructed of an electrically conductive material.

14. The device defined in claim 10 wherein said spindles are constructed of an electrically conductive material, said spiral electrical conductor is a raised lip formed integrally with said spindle and projecting outwardly therefrom, and said spindles are electrically isolated from each other.

15. The device defined in claim 10 wherein said print control means comprises:

first and second shift registers, each of said shift registers being capable of storing information corresponding to one complete line of marks;

means for receiving said video-type signal corresponding to one print line of marks into one of said registers and receiving said video-type signal corresponding to the next print line of marks into the other of said shift registers, the video-type signal being alternately shifted between said shift registers;

means for alternately unloading the information stored in said shift registers to the spiral electrical conductors, the inactive shift register being unloaded during the period that the other of said shift registers is being loaded; and means to determine the end of each page of information and provide a space between adjacent pages;

and wherein one of said shift registers is loaded and the other of said shift registers is unloaded during each refresh cycle of said recirculating-type buffer memory device.

16. A digital printer for printing in alpha-numeric character form digital information received from a recirculating-type buffer memory device in the form of a video-type signal refreshed at a predetermined rate, which comprises:

a plurality of spindles mounted in tandem on a common rotatable shift, each of said spindles having a spiral electrical conductor at its periphery extending 360° around said spindle, said electrical conductors being electrically isolated from each other, the spiral conductors on adjacent spindles being displaced 180°, and wherein the spiral conductors on abutting spindles are terminated in the same exact transverse plane;

a synchronous electric motor for rotatably driving said spindles at a substantially constant speed;

a rotatably mounted paper drive roller for moving a continuous sheet of paper past said rotatable spindles in a direction normal to the axis of said spindles;

a speed reducing gear train for rotatably driving said paper drive roller from said synchronous electrical motor in the same direction of rotation as said spindles and at a speed of rotation proportional to, but substantially less than the speed of rotation of said spindles so that the paper and the segments of said spiral electrical conductors in juxtaposition thereto are moving in the same direction, with the velocity of the paper being substantially less than the tangential velocity of the spiral conductors;

printing means for forming a mark on said paper responsive to an electrical signal applied to said spiral electrical conductors;

printer control means for receiving a video-type electronic signal representative of alpha-numeric characters corresponding to said digital information and simultaneously producing a plurality of electrical output signals corresponding in number to the number of said spindles, each of said electrical output signals being in phase sequence with the rotation of the respective spindle, said means including (1) first and second shift registers, each of said shift registers being capable of storing information corresponding to one complete print line of marks, (2) means for loading said video-type signal corresponding to one complete line of marks into one of said registers and loading said video-type signal corresponding to the next print line of marks into the other of said shift registers, the video-type signal being alternately shifted between said shift registers, (3) means for alternately unloading the information stored in said shift registers to the spiral electrical conductors, the inactive shift register being unloaded during the period that the other of said shift registers is being loaded, one of said shift registers being loaded and the other of said shift registers being unloaded during each refresh cycle of said recirculatingtype buffer memory device, and (4) means to determine the end of each page of information and provide a space between adjacent pages, said printer control means and said synchronous motor being supplied with power from a common source;

whereby a matrix of marks is placed on the paper so as to form alpha-numeric characters corresponding to said digital information.

17. The device defined in claim 16 wherein said spindles are constructed of a non-electrically conductive material and said spiral electrical conductor is constructed of an electrically conductive material.

18. The device defined in claim 16 wherein said spindles are constructed of an electrically conductive material, said spiral electrical conductor is a raised lip formed integrally with said spindle and projecting outwardly therefrom, and said spindles are electrically isolated from each other.

* * * * *